US005251577A

United States Patent [19]

Kojima

[11] Patent Number: 5,251,577

[45] Date of Patent: Oct. 12, 1993

[54] WATER JACKET ARRANGEMENT FOR MARINE TWO CYCLE INTERNAL COMBUSTION ENGINE

[75] Inventor: Akinori Kojima, Hamamatsu, Japan

[73] Assignee: Sanshin Kogyo Kabushiki Kaisha, Hamamatsu, Japan

[21] Appl. No.: 658,538

[22] Filed: Feb. 21, 1991

Related U.S. Application Data

[62] Division of Ser. No. 481,978, Feb. 16, 1990, Pat. No. 5,048,467.

[30] Foreign Application Priority Data

Feb. 17, 1989 [JP] Japan ..... 1-36109

[51] Int. Cl.[5] ..... F02B 75/18

[52] U.S. Cl. ..... 123/41.74; 123/41.08; 123/41.82 R; 123/73 R

[58] Field of Search ..... 123/41.08, 41.09, 41.31, 123/41.72, 41.74, 41.75, 41.78, 41.82 R, 65 R, 73 R, 73 A, 193 C, 195 R, 195 P; 60/320, 321

[56] References Cited

U.S. PATENT DOCUMENTS 3,358,654 12/1967 Shanahan et al. ..... 60/321

4,167,160 9/1979 Matsushita et al. ..... 123/73 R

*Primary Examiner*—Noah P. Kamen

*Attorney, Agent, or Firm*—Ernest A. Beutler

[57] ABSTRACT

An outboard motor having an improved cooling system wherein liquid coolant is circulated through an exhaust manifold cooling jacket then through a cylinder head cooling jacket and then through an upper portion of the cylinder block cooling jacket. A thermostatic valve controls the flow from the upper cylinder block cooling jacket through a lower cylinder block cooling jacket so as to avoid quenching of the intake charge by coolant which has not reached operating temperature.

5 Claims, 5 Drawing Sheets

WATER JACKET ARRANGEMENT FOR MARINE TWO CYCLE INTERNAL COMBUSTION ENGINE

This is a division of U.S. patent application Ser. No. 481,978, filed Feb. 16, 1990 now U.S. Pat. No. 5,048,467.

BACKGROUND OF THE INVENTION

This invention relates to a water jacket arrangement for a marine two cycle internal combustion engine and more particularly to an improved cooling system for an internal combustion engine.

In water cooled internal combustion engines, it is the normal practice to provide a separate cooling jacket for the cylinder head and cylinder block. With V type engines, each cylinder head and each bank of the cylinder block normally has its own cooling jacket. It is conventionally the practice to pass the cold cooling water first through the cylinder block cooling jacket and then through the cylinder head cooling jacket. This arrangement, however, has several disadvantages.

In the first instance, the cylinder head normally has the higher heat loading associated with it and when the cooling water is first circulated through the cylinder block, there is not as great a differential between the temperature of the cooling water and the cylinder head. Cooling efficiency is therefore diminished. Furthermore, if the engine is operated on the two stroke crankcase compression principle, as is common with may liquid cooled engines, then the cold cooling water is also in proximity to the scavenge passages of the cylinder block and tends to quench them. This will cause condensation of the fuel in the fuel/air mixture that is transferred from the crankcase to the combustion chambers through these scavenge passageways. Accordingly, poor running conditions will result.

The aforenoted problems are particularly acute in conjunction with marine propulsion engines. These engines normally receive cooling water from the body of water in which they are operating, circulate it through the cooling jackets and then return it back to the body of water. As a result, the inlet water tends to be at a lower temperature than engines having closed cooling systems and employing a heat exchanger. Hence, the aforenoted problems are particularly acute with marine propulsion engines.

It is, therefore, a principal object of this invention to provide an improved cooling arrangement for an internal combustion engine.

It is a further object of this invention to provide a cooling system for an internal combustion engine wherein the cylinder block and cylinder head will each receive adequate degrees of cooling.

It is a still further object of this invention to provide an improved cooling system for a two cycle crankcase compression type of internal combustion engine.

It is a yet further object of this invention to provide an improved cooling system for a marine propulsion engine.

SUMMARY OF THE INVENTION

This invention is adapted to be embodied in a cooling arrangement for a liquid cooled internal combustion engine having a cylinder block with a cooling jacket. A cylinder head is affixed to the cylinder block and also has a cooling jacket. In accordance with the invention, means are provided for circulating liquid coolant first through the cylinder head cooling jacket and then through the cylinder block cooling jacket.

DESCRIPTION OF THE PREFERRED EMBODIMENT OF THE INVENTION

Figure 1:
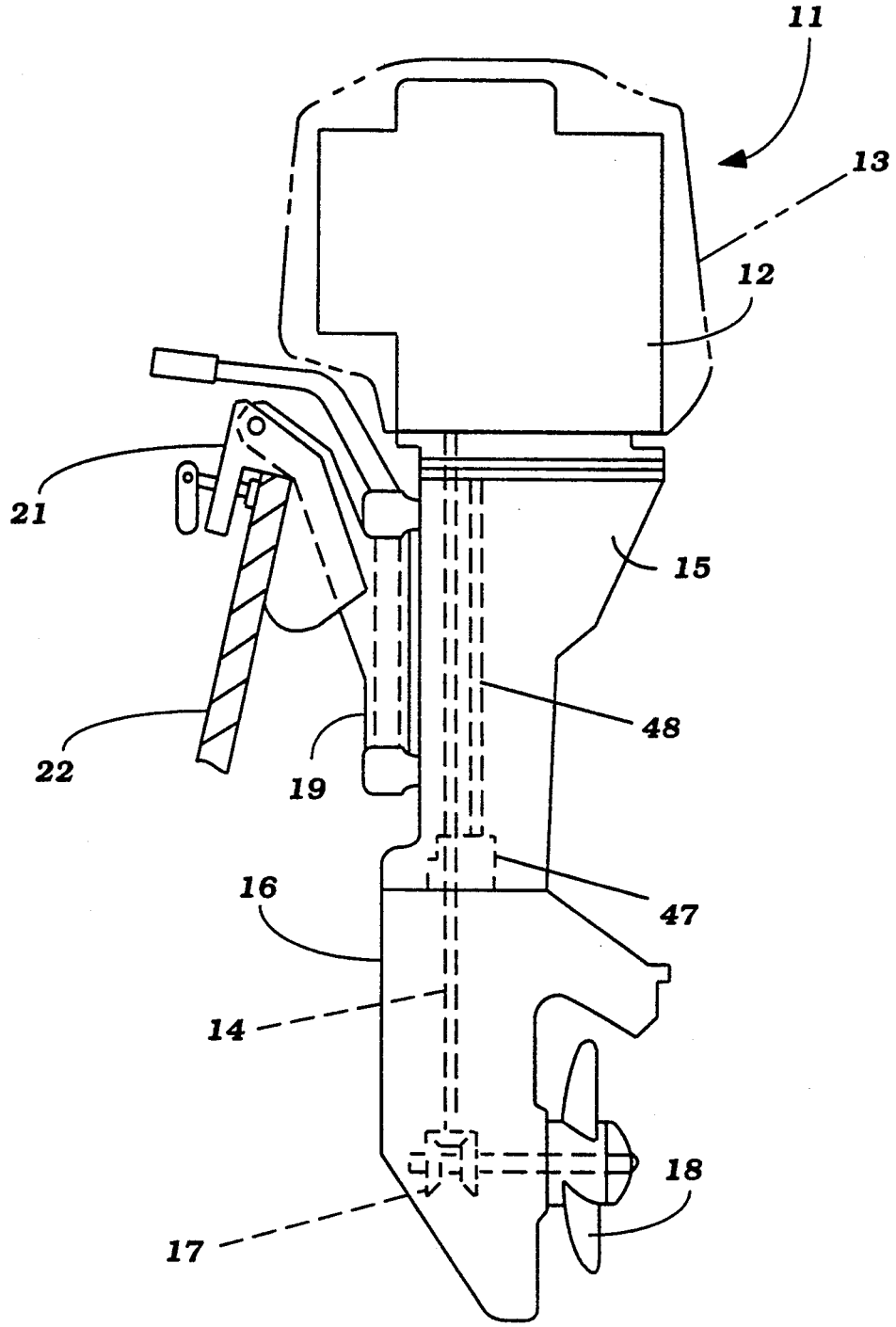
FIG. 1 is a side elevational view of an outboard motor constructed in accordance with an embodiment of the invention, as attached to the transom of a watercraft, shown partially and in section, with portions of the outboard motor shown in phantom.

Referring first to FIG. 1, an outboard motor constructed in accordance with an embodiment of the invention is identified generally by the reference numeral 11. The invention is depicted in conjunction with an outboard motor since the invention has particular utility in connection with marine propulsion engines wherein the cooling water is drawn from the body of water in which the watercraft is operating. In addition, certain facets of the invention have particular utility in conjunction with two cycle crankcase compression internal combustion engines and such engines are conventionally used in conjunction with outboard motors.

The outboard motor 11 includes a power head in which an internal combustion engine, of a type to be described and indicated generally by the reference numeral 12, is positioned. The internal combustion engine 12 is surrounded by a protective cowling 13 which is shown in phantom in FIG. 1 and only partially in certain of the remaining figures. As is conventional with outboard motor practice, the engine 12 is supported so that its output shaft, to be described, rotates about a vertically extending axis.

The engine output shaft is coupled to a drive shaft 14 that is journaled for rotation within a drive shaft housing 15 and which extends into a lower unit 16 wherein a forward, neutral, reverse transmission 17 is provided for driving a propeller or other propulsion device 18 in selected forward and reverse directions.

The outboard motor 11 further includes the normal swivel bracket 19 which is pivotally connected to a clamping bracket 21 for attachment to a watercraft hull transom 22 in a known manner. As has been previously noted, the outboard motor 11 is described only as a typical environment in which the invention can be employed. For that reason, further details of the description of the outboard motor 11, apart from the engine and its cooling system, are believed to be unnecessary to enable those skilled in the art to practice the invention.

Figure 2:
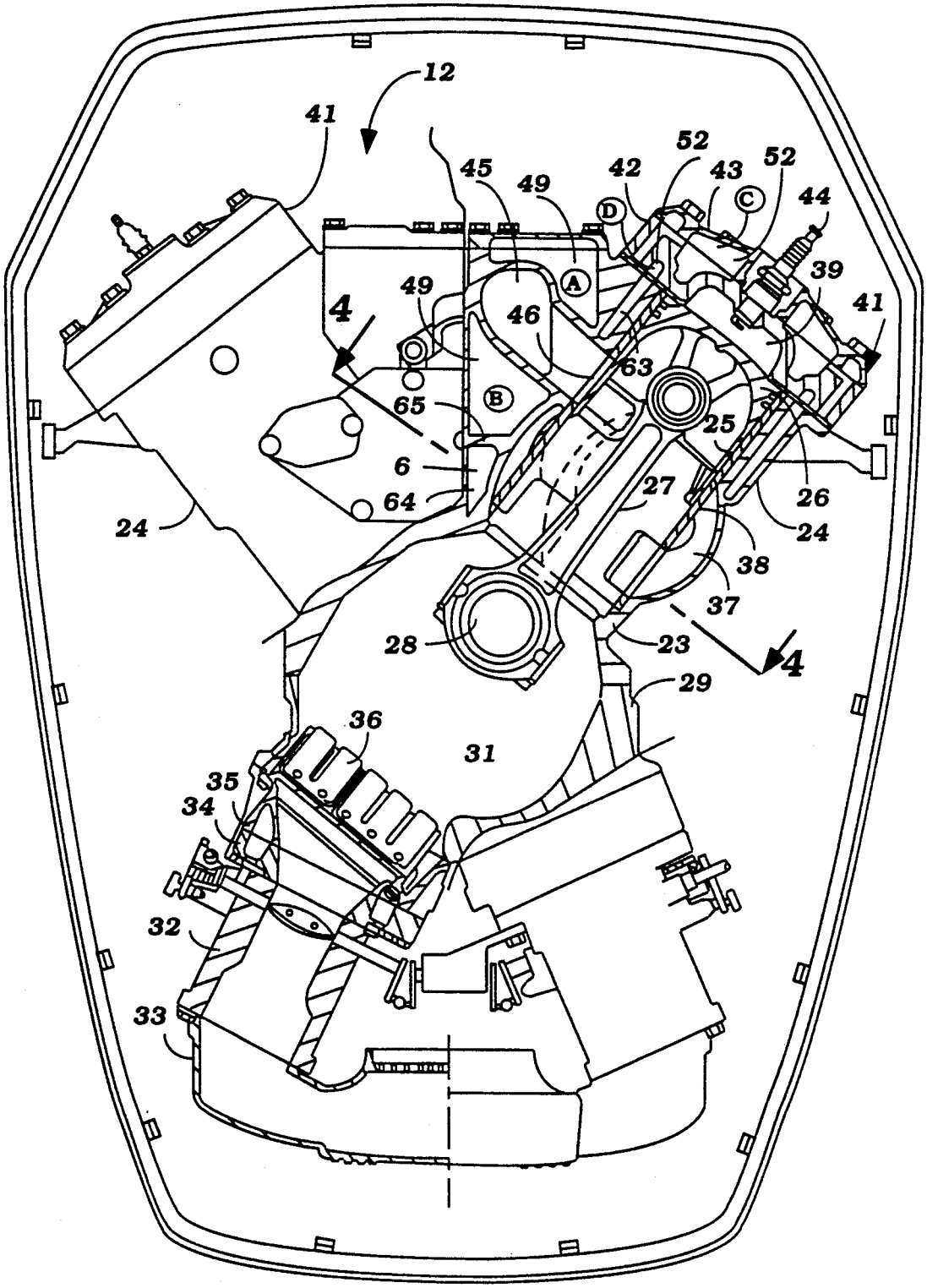
FIG. 2 is an enlarged top plan view of the power head with a portion of the protective cowling removed and parts of the engine broken away and shown in section.
Figure 3:
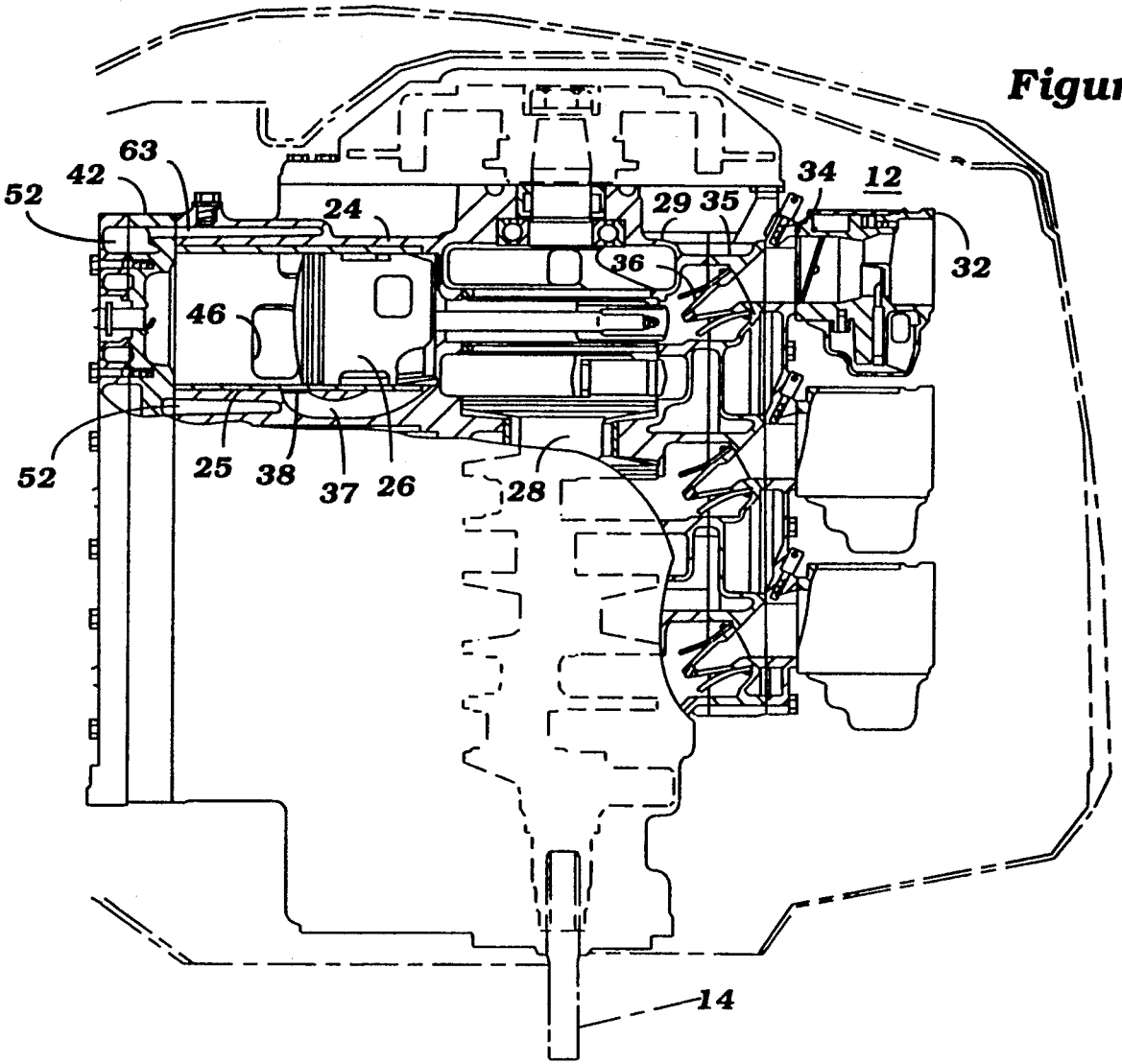
FIG. 3 is an enlarged side elevational view of the power head, with portions shown in phantom and other portions broken away.
Figure 4:
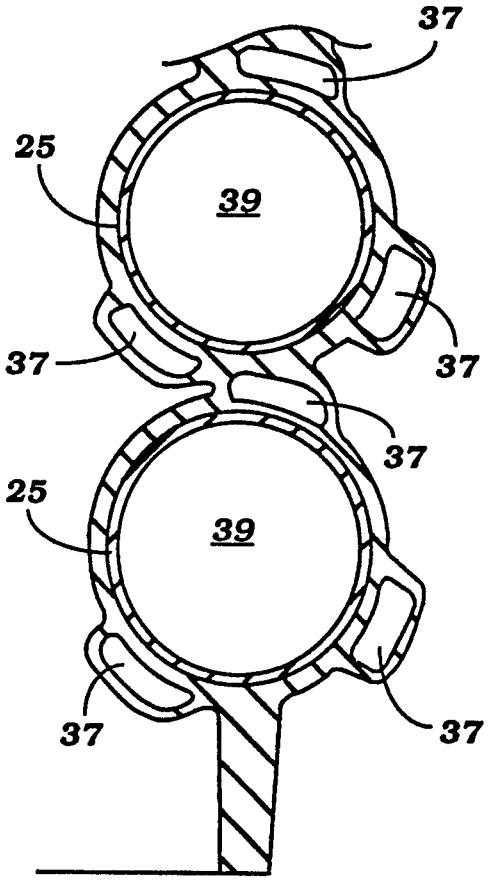
FIG. 4 is a partial cross sectional view taken generally along the line 4—4 of FIG. 2.

Referring now in detail to FIGS. 2 through 4, the construction of the engine 12 will be described. In the depicted embodiment, the engine 12 is of the V type operating on a crankcase compression two cycle principle. It is to be understood, of course, that certain facets of the invention can be utilized in conjunction with four cycle engines, but the invention has particular utility in two cycle engines. Also, the invention can be utilized with engines having other than a V type configuration.

The engine 12 includes a cylinder block 23 having a pair of angularly disposed cylinder banks 24. Each cylinder bank 24 is provided with a plurality of aligned bores, three in this instance, that are formed by pressed in cylinder liners 25. Pistons 26 reciprocate within these cylinder bores and are connected by means of connecting rods 27 to drive a crankshaft 28 for rotation about the aforenoted vertically extending axis.

The crankshaft 28 is journaled within a crankcase chamber formed by the cylinder block 23 and a crankcase 29 in a known manner. This crankcase is divided into a plurality of individual chambers 31, one of which is associated with each of the cylinder bores formed by the liners 25. A fuel/air charge is delivered to the individual crankcase chambers 31 by an induction system which may be of any known type. In the illustrated embodiment, for exemplary purposes the induction system is depicted as being comprised of six individual carburetors 32 which receive an air charge from an air inlet device 33. This air charge is then transferred through a spacer plate 34 and manifold assembly 35 to the individual crankcase chambers 31. Reed type check valves 36 are provided at the base of the manifold passages 35 where they discharge into the crankcase chambers 31 for preventing reverse flow, as is well known in this art.

The charge which is admitted to the individual crankcase chambers 31 during the upstroke of the pistons 26 is compressed during their downstroke and then is transferred to a combustion chamber, to be described, through a plurality of scavenge passages indicated generally by the reference numeral 37 and which are circumferentially disposed around the cylinder bores defined by the liners 25. In the illustrated embodiment, there are provided three such scavenge passages 37 for each cylinder. Of course, the invention can be utilized in conjunction with other configurations. Each scavenge passage 37 discharges into the cylinder bore through a scavenge port 38.

There is formed a combustion chamber 39 between the head of the piston 26, the cylinder bore defined by the liners 25 and a cylinder head assembly, indicated generally by the reference numeral 41. There is a cylinder head assembly 41 affixed to each of the cylinder banks. This cylinder head assembly 41 includes a lower member 42 and an upper member 43 which are affixed to each other and to the cylinder block 23 in a known manner. The cylinder head assembly 41 is formed with recesses which complete the aforedescribed combustion chamber. Spark plugs 44 are provided in the cylinder head assembly 41 and are fired by means of an appropriate ignition system to burn the charge which has been transferred to the combustion chambers 39. The burnt charge is then discharged into an exhaust manifold assembly comprising individual runners 45 that are formed in the valley of the V between the cylinder banks 24 through individual exhaust ports 46 that extend through the cylinder liners 25. These exhaust gases are then discharged downwardly through an exhaust system (not shown) that is contained within the drive shaft housing 15 for discharge through the propeller exhaust or other underwater discharge. In addition, there may be provided an above the water low speed exhaust, as is well known in outboard motor practice.

The construction of the engine 12 as thus far described may be considered to be conventional. As has been previously noted, the invention deals with the cooling system for the engine and this cooling system will now be described by reference to all figures. Referring first to FIG. 1, it should be noted that the outboard motor 11 is provided with a water pump 47 that is positioned at the interface between the drive shaft housing 15 and the lower unit 16. The water pump 47 is driven from the driveshaft 14 in a known manner and draws water through a water inlet formed in the lower unit 16. This water is then delivered through a supply passage 48 to the cooling jackets of the engine 12 in a manner as now will be described.

Referring again primarily to FIGS. 2 through 4, the engine 12 is provided with a plurality of cooling jackets. These cooling jackets comprise a first cooling jacket assembly 49 which encircles the exhaust system and specifically the runners 45 and their collector sections. This cooling jacket 49 is, however, provided essentially on an area that is spaced primarily from the cylinder block 23 and specifically the cylinder banks 24. The flow of coolant, as will be described, first enters the cooling jacket 49 and flows through a section indicated by the reference character A and then exits through a jacket section indicated by the reference character B.

Figure 5:
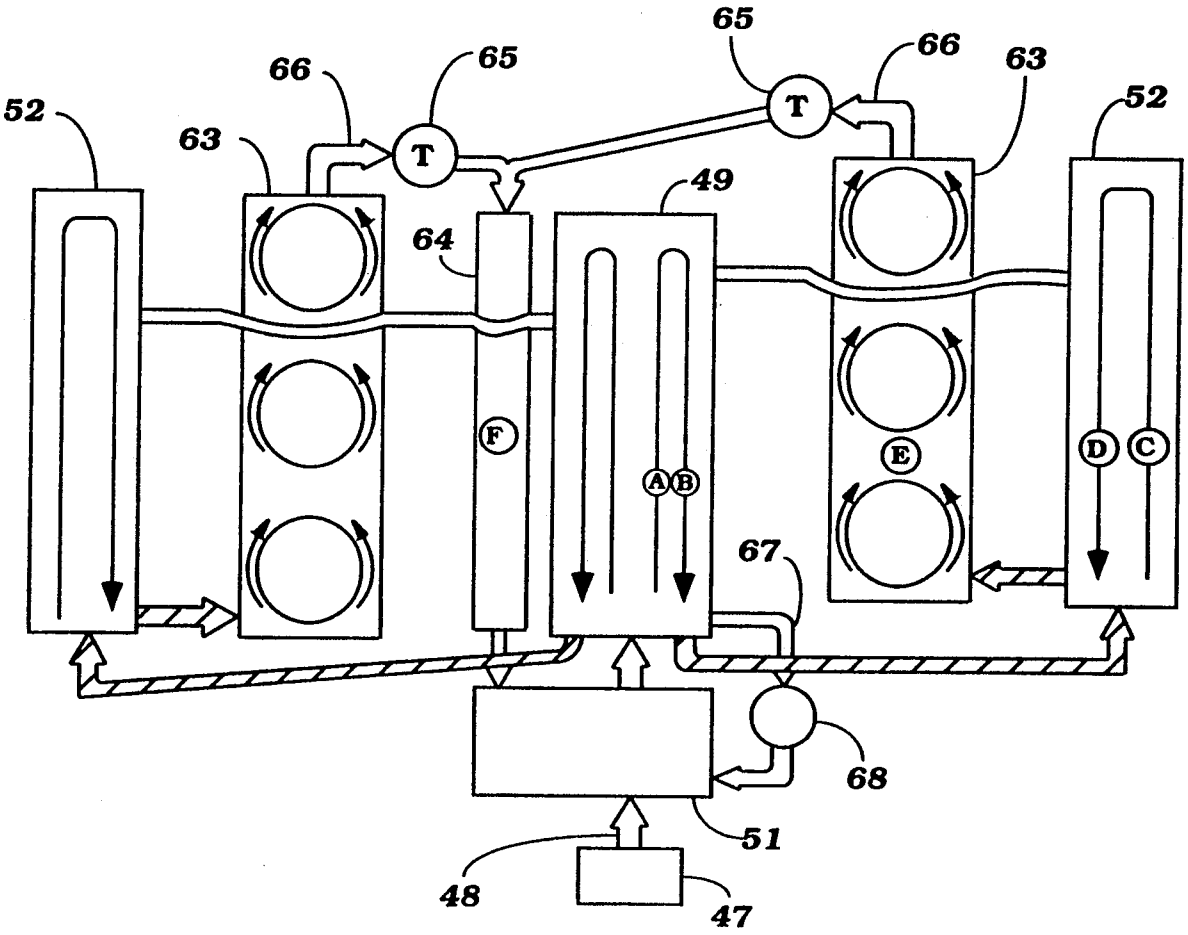
FIG. 5 is a schematic view of the engine and the cooling flow therethrough.

This schematic flow is shown in FIG. 5 and it will be noted that water is delivered to the exhaust manifold cooling jacket 49 from the conduit 48 through a distributor plate 51 that is interposed between the drive shaft housing 15 and the power head and specifically the lower face of the engine 12.

Water that has passed through the exhaust manifold cooling jacket 49 is then delivered to cooling jackets 52 that are formed within the cylinder head assemblies 41. The water enters the cylinder head cooling jackets 52 in an area and direction as shown by the letter C and then exits through a return passage D into a cooling jacket 53 formed on the upper portion of the cylinder blocks and specifically the banks 24. It should be noted that the cylinder block is divided into the upper cooling jacket 63 which is disposed substantially above the intake or scavenge ports 37 and which surround the cylinder liners 25. There is further provided a lower cylinder block cooling jacket 64 that is disposed at the lower portion of the cylinder blocks and adjacent the crankcase chambers 31. A dividing wall 65 as, best seen in FIG. 2, divides the cylinder block cooling jacket 63 from the cylinder block cooling jacket 64 and also from the manifold cooling jacket 49. As a result, the water will be adequately heated before it reaches the lower portion of the cylinder block.

Thermostatic valves 65 (FIG. 5) are positioned in conduits 66 that extend from the cylinder block cooling jacket 63 to the cylinder block cooling jacket 64. As a result, the coolant will not be delivered to the lower cylinder block cooling jacket 64 until the coolant has been heated to the engine operating temperature so as to avoid quenching of the crankcase chambers 31. The flow of water through the cylinder block cooling jackets is indicated by the reference characters E and F, respectively.

Cooling water is then returned from the lower cylinder block cooling jacket 64 back to the body of water in which the watercraft is operating through the spacer distributer plate 51 and a suitable water discharge of the type well known in this art.

There is provided bypass passageway 67 (FIG. 5) that extends from the exhaust manifold cooling jacket 49 back to the water discharge through the distributer plate 51. A pressure responsive valve 68 is provided in this bypass passageway so as to maintain a pressure relief within the cooling system as thus far described and also so as to insure that excess pressure will not be encountered when the thermostatic valves 65 are closed.

It should be readily apparent from the foregoing description that the described cooling system is highly effective in insuring adequate cooling for the engine 12 and good warm up. In addition, it is insured that there will be no quenching of the intake charge in either the scavenge passages or in the crankcase. The foregoing description is, of course, that of a preferred embodiment of the invention. Various changes and modifications may be made without departing from the spirit and scope of the invention as defined by the appended claims.

I claim:

1. A cooling arrangement for a liquid cooled internal combustion engine having a cylinder head cylinder block assembly comprising a cylinder block with a cooling jacket and a cylinder head affixed to said cylinder block and having a cooling jacket, and exhaust port formed in said cylinder head cylinder block assembly for discharging exhaust gases from said engine, an exhaust cooling jacket formed in said cylinder head, cylinder block assembly encircling said exhaust port, and means for circulating liquid coolant first through said exhaust cooling jacket, then through said cylinder head cooling jacket and then through said cylinder block cooling jacket.

2. A cooling arrangement as set forth in claim 1 wherein the engine is a two cycle crankcase compression internal combustion engine.

3. A cooling arrangement as set forth in claim 2 wherein the engine cylinder block is provided with scavenge passage terminating in a scavenge port for conveying a charge from the crankcase to the combustion chamber thereof.

4. A cooling arrangement as set forth in claim 3 wherein the cylinder block has an upper cooling jacket and a lower cooling jacket, the upper cooling jacket being spaced from the scavenge passage and wherein the means for circulating liquid coolant circulates the liquid coolant through the upper portion of the cylinder block cooling jacket before the lower portion of the cylinder block cooling jacket.

5. A cooling arrangement as set forth in claim 4 further including a thermostatic valve positioned between the upper cylinder block cooling jacket and the lower cylinder block cooling jacket for preventing flow of liquid cooling through the lower cylinder block cooling jacket until the coolant is above a predetermined temperature.

* * * * *